United States Patent [19]

Hartley

[11] 4,081,621

[45] Mar. 28, 1978

[54] PRESSURE SWITCH WITH DIAPHRAGM AND VALVE MEANS

[75] Inventor: Ezra Dale Hartley, Los Angeles, Calif.

[73] Assignee: Carr-Griff, Inc., Anaheim, Calif.

[21] Appl. No.: 680,190

[22] Filed: Apr. 26, 1976

[51] Int. Cl.[2] ..... H01H 35/34

[52] U.S. Cl. ..... 200/83 Q; 200/83 T; 200/83 A; 417/38

[58] Field of Search ..... 200/83 J, 83 R, 83 T, 200/83 Q, 83 A, 83 W, 81 R, 81.9 R; 340/239 R, 240; 417/38

[56] References Cited

U.S. PATENT DOCUMENTS

| | | | |
|---|---|---|---|
| 2,773,251 | 12/1956 | Snyder | 200/81.9 R |
| 3,711,222 | 1/1973 | Hartley | 417/44 |
| 3,739,810 | 6/1973 | Horan, Jr. | 417/38 |
| 3,922,111 | 11/1975 | Deters | 417/38 |

*Primary Examiner*—Gerald P. Tolin

*Attorney, Agent, or Firm*—Gordon L. Peterson

[57] ABSTRACT

A pressure switch comprising a housing and a movable pressure responsive diaphragm in the housing cooperating therewith to define a sensing chamber. The housing has an inlet passage leading to the sensing chamber and a vent passage leading from the sensing chamber. A check valve allows fluid to flow through the inlet passage into the sensing chamber and prevents flow through the inlet passage in the reverse direction. A pressure relief valve at least partially vents the sensing chamber through the outlet passage in response to the differential pressure across the pressure relief valve reaching about a predetermined magnitude. At least a portion of the diaphragm is movable along a path in response to pressure changes in the sensing chamber and an actuator is carried by the movable portion of the diaphragm. A switch is mounted on the housing in a position to be actuated by the movement of the actuator.

14 Claims, 1 Drawing Figure

PRESSURE SWITCH WITH DIAPHRAGM AND VALVE MEANS

BACKGROUND OF THE INVENTION

A pressure switch typically includes a switch and pressure responsive means for actuating the switch. The pressure responsive means may be arranged, for example, to close the switch at a first relatively low pressure and to open the switch at a second relatively high pressure. Pressure switches of this kind are shown in my U.S. Pat. Nos. 3,651,292 and 3,711,222.

Pressure switches have many uses. For example, in a pressurized water system for recreational vehicles, water pressure may be provided by a pump which is driven by an electric motor with pressure downstream of the pump being maintained by an accumulator or other suitable means. A pressure switch may be used to turn the pump on in response to a relatively low pressure downstream of the pump and to turn the pump off when pressure downstream of the pump reaches a predetermined higher level.

SUMMARY OF THE INVENTION

The present invention provides a simple, inexpensive, and reliable pressure switch which is adapted for use with a source of fluid under variable pressure. This is advantageously accomplished by providing a sensing chamber and permitting flow of fluid from the pressure source into the sensing chamber and allowing flow of fluid out of the sensing chamber when the pressure difference between the sensing chamber and the source reaches a predetermined magnitude. Actuator means responds to the pressure changes in the sensing chamber to control a switch.

The source of fluid under variable pressure may be, for example, a closed water system downstream of a pump. The flow of fluid into the sensing chamber from the source may be through a check valve which prevents reverse flow of fluid therethrough from the sensing chamber to the source. This allows pressure to build up in the sensing chamber as the pressure of the source is increased, as by operation of the pump, and prevents pressure in the sensing chamber from diminishing as the pressure of the source diminishes.

The flow of fluid out of the sensing chamber can advantageously be controlled by a pressure relief valve which is responsive to the pressure in the sensing chamber being of a predetermined magnitude greater than the pressure of the source for reducing the pressure in the sensing chamber by venting this chamber to the source or elsewhere.

Although the actuator means can take different forms, it can advantageously include a pressure responsive member such as a diaphragm. For example, a portion of the diaphragm may be movable along a path in response to pressure changes in the sensing chamber. This may be accomplished, for example, by providing a housing and using the diaphragm and the housing to define the chamber. The actuator means may also include a plunger or other element carried or moved by the diaphragm so as to provide movement in response to pressure changes within the chamber.

A switch is mounted on the housing. The switch may have a switch operating element in the path of movement of the actuator means so that movement of the actuator means can operate the switch.

The housing may include a plurality of housing sections. The diaphragm may be molded with an integral seal which is clamped between two or more of the housing sections to provide a seal therebetween.

The pressure relief valve can advantageously include a valve member extending through an opening or vent passage in the housing. A portion of the valve member outside of the housing is cooperable with a portion of the housing to seal the vent passage. The valve member can also be used, if desired, as a stem for mounting a check valve element which is used for purposes outside of the sensing chamber. The check valve that prevents reverse flow out of the sensing chamber can advantageously include a resilient washer coaxial with the valve member and overlying an inlet passage formed in the housing and leading from the source to the sensing chamber.

The invention, together with further features and advantages thereof, may best be understood by reference to the following description taken in connection with the accompanying illustrative drawing.

BRIEF DESCRIPTION OF THE DRAWING

The drawing is a fragmentary sectional view of a pressure switch constructed in accordance with the teachings of this invention. The pressure switch is shown as being used in a water supply system with the components of such system being shown schematically.

DESCRIPTION OF THE PREFERRED EMBODIMENT

Figure 1:
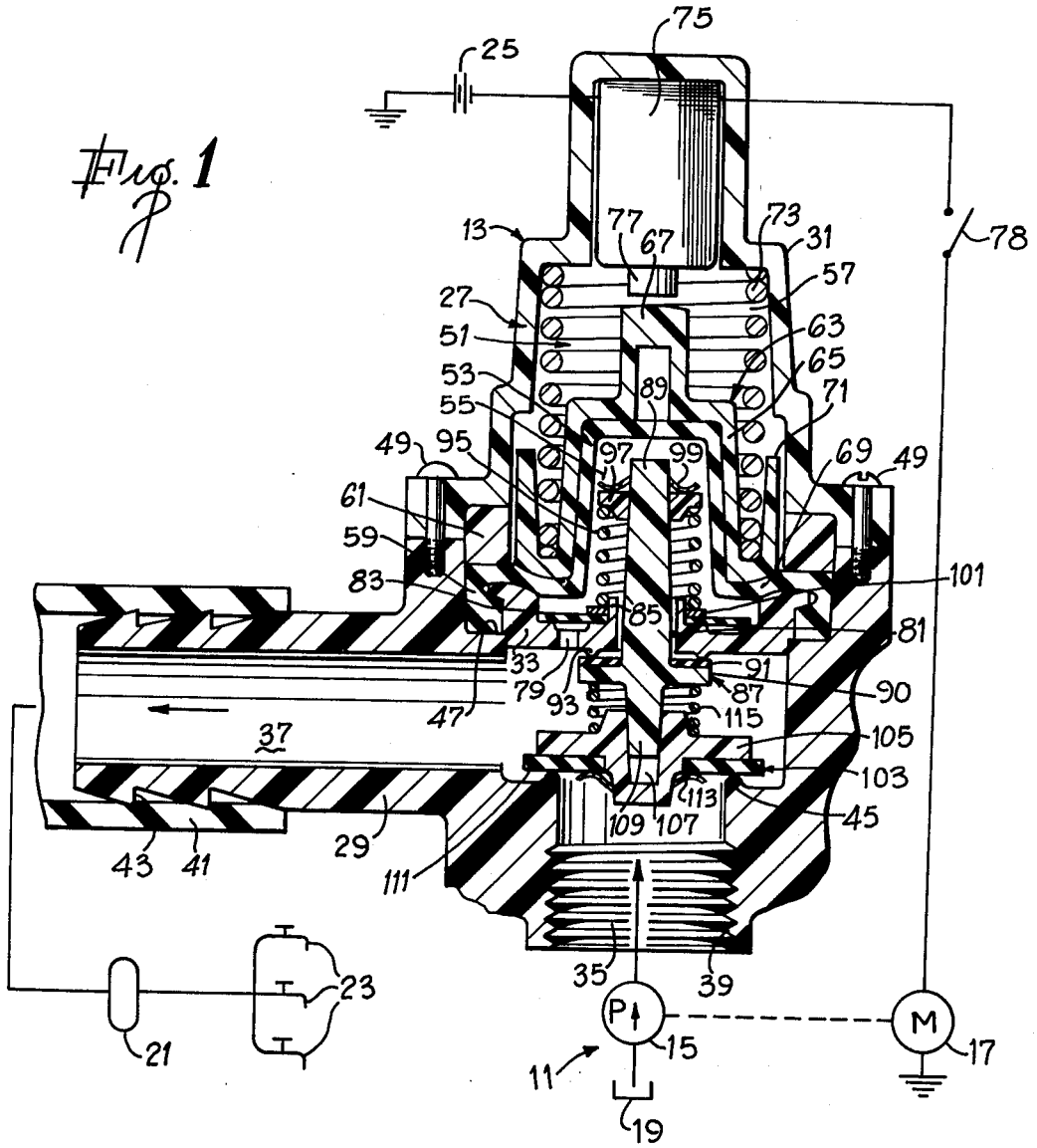

The drawing shows a pressurized water system 11 for a recreational vehicle which includes a pressure switch 13 constructed in accordance with the teachings of this invention. The pressure switch 13 has many different uses and can be used in many different environments, and its use in the water system 11 is purely illustrative.

In the embodiment illustrated, the water system 11 also includes a pump 15 driven by an electric motor 17. The pump 15 pumps water from a water supply 19 through a portion of the pressure switch 13 and an accumulator tank 21 to a plurality of manually operable valves or faucets 23. A battery 25 supplies electrical energy to the motor 17 in a manner described hereinbelow. Except for the pressure switch 13, the water system 11 may be of conventional construction.

The pressure switch 13 includes wall means defining a housing 27 which, in the embodiment illustrated, is constructed of molded plastic material. Although the housing 27 can be of various different configurations, in the embodiment illustrated, it includes a base housing section 29, a cover housing section 31, and a partition or interior housing section 33. The housing section 29 has an inlet passage 35 and an outlet passage 37 therein extending at right angles to each other. The inlet passage 35 has means such as screw threads 39 for attaching the housing 27 to a source of fluid under pressure such as the discharge end of the pump 15. The outer end of the outlet passage 37 is adapted for connection to a conduit 41 in any suitable manner such as by barbs 43. The outlet passage 37, the conduit 41, and the accumulator tank 21 constitute a source of fluid under variable pressure.

The interior of the housing section 29 has an integral annular valve seat 45. The upper end of the housing section 29 is open, and an annular shoulder 47 faces upwardly near the open upper end of the housing section 29.

The cover housing section 31 is removably attached to the base section 29 in any suitable manner such as by a plurality of screws 49. The interior housing section 33 closes the open upper end of the base housing section 29 and rests on an inner annular portion of the shoulder 47.

The housing sections 29, 31 and 33 cooperate to define a cavity 51. A resilient diaphragm 53 is appropriately clamped in position by the three housing sections 29, 31 and 33 and divides the cavity 51 into a pressure or sensing chamber 55 and a switch chamber 57. The diaphragm 53 is constructed of a suitable flexible material such as rubber or plastic. A peripheral region of the diaphragm 53 is enlarged to define an integral annular seal 59 which provides a seal between the housing sections 29 and 33. An outer annular region of the diaphragm 53 is clamped between an end face of the housing section 33 and an annular ring 61 which bears against the housing section 31. The diaphragm 53, being flexible, is movable axially in the cavity 51 to the extent that it is not restrained by other members of the pressure switch.

A plunger 63, which may be constructed of rigid plastic material is provided in the switch chamber 57. The plunger 63 may be of various different constructions; however, in the embodiment illustrated, it includes a cup-shaped section 65, a projection 67 extending axially of the end wall of the cup-shaped section, a radial flange 69, and an annular outer skirt 71. A coil spring 73 in the switch chamber 57 acts between the flange 69 and a shoulder on the housing section 31 to urge the plunger 63 and the diaphragm 53 downwardly as viewed in the drawing.

An electric switch 75 of conventional construction is suitably mounted in the housing section 31. The switch 75 has a switch operating element 77 which is spring biased downwardly and which projects axially downwardly toward the projection 67. The switch 75 opens when the element 77 is moved upwardly a predetermined amount from the position shown in the drawing and is closed when the element 77 is in the position shown in the drawing. The switch 75 is connected in series with a manual switch 78, the battery 25, and the motor 17 so that it can turn the motor on and off.

The housing section 33, which forms a bottom wall for the sensing chamber 55, has an inlet passage 79 and an opening in the form of an outlet or vent passage 81. Both of the passages 79 and 81 lead from the outlet passage 37 to the interior of the sensing chamber 55.

The inlet passage 79 is normally closed by a check valve 83 which, in the embodiment illustrated, is in the form of an annular, flexible resilient washer of rubber or other suitable material. The housing section 33 has an integral boss 85, which forms an extension of the outlet passage 81, and the check valve 83 is mounted on the boss 81 and is co-axial therewith. The check valve 83 allows fluid to flow from the outlet passage 37 through the inlet passage 79 into the sensing chamber 55, but prevents fluid from flowing from the sensing chamber to the outlet passage 37 in the reverse direction through the inlet passage 79.

The vent passage 81 is normally closed by a pressure relief valve 87. The pressure relief valve 87 includes a valve member 89 which extends through the vent passage 81 so that a portion of the valve member is within the sensing chamber 55 and a portion of the valve member is outside of the sensing chamber. The valve member 89 has an annular flange 90 in the outlet passage 37 which carries a resilient annular washer 91 which defines a valve surface. The washer 91 is engageable with an annular valve seat 93 molded integrally with the housing section 33. The valve member 89 is movable axially in the vent passage 81 and is spaced from the wall of the vent passage to define a radial clearance space. A spring 95 in the sensing chamber 55 is normally operative to urge the valve member 89 upwardly so that the washer 91 engages the valve seat 93 to close the outlet passage 81. Although this result can be brought about in various different ways, in the embodiment illustrated, the spring 95 bears against a collar 97 which is held on the valve member 89 by an annular retainer 99. The other end of the spring 95 bears on a washer 101 which surrounds the boss 85 and which bears against an inner annular region of the check valve 83.

The pressure switch 13 includes, as an optional element thereof, a second check valve 103. Although the check valve 103 can take various different forms, in the embodiment illustrated, it includes a check valve element 105 having a central passage 107 for receiving an axial extension 109 of the valve member 89. Thus, the extension 109 of the valve member 89 mounts the valve element 105 for axial movement relative to the valve member. If desired, the valve element 105 may also include a resilient washer 111 and a retainer 113. A spring 115 acting between the valve member 89 and the valve element 105 urges the latter downwardly as seen in the drawing so that the washer 111 engages the valve seat, which also forms a portion of the check valve 103.

Assuming that there is no pressure in the water system 11, closure of the manual switch 78 will complete a circuit from the battery 25 through the switches 75 and 78 to the motor 17. This drives the pump 15 to pump water from the water supply 19 to the check valve 103. The fluid pressure at the discharge end of the pump 15 is sufficient to overcome the biasing force of the spring 115 whereupon the check valve 103 opens to allow flow of water to the accumulator 21. Thus, the valve 103 serves as the outlet check valve for the pump 15. Because the check valve 83 opens to allow water to flow from the outlet passage 37 through the inlet passage 79 into the sensing chamber 55, the pressure within the sensing chamber 55 is substantially the same as the pressure in the outlet passage 37. As the accumulator 21 fills with water, the pressure in the outlet passage 37 increases, and the pressure in the sensing chamber 55 increases a corresponsing amount.

Because the diaphragm 53 is flexible, it responds to pressure increases in the pressure chamber 55 by moving axially upwardly. This axial upward movement of the diaphragm 53 moves the plunger 63, and specifically the projection 67, upwardly and into engagement with the switch operating element 77. When the switch operating element 77 has been moved upwardly to a predetermined position, the switch 75 opens thereby breaking the circuit to the motor 17 and turning off the pump 15. Thus the diaphragm 53 and the plunger 63 serve as actuator means for the switch 75.

As the faucets 23 are opened and water from the accumulator 21 is used, the pressure in the outlet passage 37 drops. However, the pressure within the sensing chamber 55 does not drop because the check valve 83 prevents reverse flow through the inlet passage 79. However, the pressure within the sensing chamber 55 can act on the area of the washer 91 and the inner face of the flange 90 that lies radially inwardly of the valve seat 93. Similarly, the pressure in the outlet passage 37 can act over a larger area; i.e., the outer of the annular flange 90. In addition, the springs 95 and 115 tend to hold the washer 91 in engagement with the valve seat 93; however, the spring 115 is a relatively light spring and does not contribute significantly to holding the pressure relief valve 87 closed.

When the pressure in the outlet passage 37 drops to a predetermined level so that the pressure in the sensing chamber 55 is a predetermined magnitude greater than the pressure in the outlet passage 37, the valve member 89 is moved downwardly as viewed in FIG. 1 against the biasing force of the springs 95 and 115 to open or vent the sensing chamber to the outlet passage 37. Because the sensing chamber 55 is of relatively small volume, this sudden opening of the vent passage 81 substantially equalizes the pressure in the sensing chamber 55 and the outlet passage 37 before the pressure relief valve 87 is closed by the spring 95. The pressure lost in the sensing chamber 55 causes the diaphragm 53 to move downwardly as viewed in the drawing to allow the switch operating element 77 to be moved downwardly to close the circuit to the motor 17. As a result, the pump 15 is restarted and the operation described above is repeated.

It will be appreciated that the pressure switch 13 is a differential pressure switch in that it turns the pump on at a relatively low pressure and turns the pump off at a relatively higher pressure. Also, the pressure switch 13 is adapted for use with various systems which have a source of fluid under variable pressure such as the closed water system 11.

Although an exemplary embodiment of the invention has been shown and described, many changes, modifications, and substitutions may be made by one having ordinary skill in the art without necessarily departing from the spirit and scope of this invention.

I claim:

1. A pressure switch usable with a source of fluid under variable pressure comprising:

means defining a chamber;

first passage means for providing communication between the source of fluid under variable pressure and the chamber;

check valve means associated with said first passage means for allowing flow of fluid from the source through the first passage means to the chamber and for substantially preventing flow of fluid from the chamber through the first passage means to the source;

actuator means responsive to the pressure in the chamber for assuming a first position in response to a first pressure in the chamber and for assuming a second position in response to a second pressure in the chamber;

switch means responsive to the actuator means being in said first position for being in a first state and responsive to the actuator means being in said second position for being in a second state; and pressure relief valve means responsive to the pressure in said chamber and the pressure of the source for reducing the pressure in said chamber in response to the pressure in the chamber exceeding the pressure of the source by a predetermined magnitude.

2. A pressure switch as defined in claim 1 wherein said chamber defining means includes a movable wall portion, said movable wall portion forming at least a portion of said actuator means.

3. A pressure switch as defined in claim 1 wherein said chamber defining means includes a wall having an opening, said pressure relief valve means includes a valve member extending through said opening and terminating outside said chamber, a portion of said valve member being engageable with a portion of said wall to close said opening.

4. A pressure switch as defined in claim 3 including a check valve member outside said chamber and carried by said valve member.

5. A pressure switch comprising:

wall means defining a housing having a flow passage extending therethrough, said flow passage having an inlet and an outlet;

a pressure responsive diaphragm in said housing and cooperating therewith to define a sensing chamber, at least a portion of said diaphragm being movable along a path in response to pressure changes in said sensing chamber;

resilient means for resisting movement of the diaphragm in at least one direction along said path;

said wall means having a vent passage leading to said sensing chamber and an inlet passage leading from said flow passage to said sensing chamber, said sensing chamber being substantially closed, except for said passages;

first check valve means for allowing fluid flow through the inlet passage and into the sensing chamber and for preventing fluid flow in the reverse direction from said sensing chamber through said inlet passage;

pressure relief valve means for at least partially venting said sensing chamber through said vent passage in response to the pressure differential across the pressure relief valve means reaching about a predetermined magnitude;

switch means mounted on said housing and operable by the movement of said movable portion of said diaphragm along said path; and said inlet passage leads from said flow passage to said sensing chamber.

6. A pressure switch as defined in claim 5 wherein said housing includes a plurality of housing sections and said diaphragm has an integral seal along the diaphragm periphery which forms a seal between at least two of said housing sections.

7. A pressure switch as defined in claim 5 wherein said housing has a cavity therein and said diaphragm divides that cavity into said sensing chamber and a switch chamber, said switch and said resilient means being in said switch chamber.

8. A pressure switch as defined in claim 5 including a plunger, said plunger having a rigid portion driven by said movable portion of said diaphragm along said path, said switch means includes a switch operating element in the path of movement of said rigid portion and being operable thereby.

9. A pressure switch as defined in claim 5 wherein said wall means has a boss thereon projecting into the sensing chamber and forming at least a portion of said vent passage, said first check valve means includes a resilient washer mounted on said boss and adapted to overlie one end of said inlet passage.

10. A pressure switch comprising:

wall means defining a housing;

a pressure responsive diaphragm in said housing and cooperating therewith to define a sensing chamber, at least a portion of said diaphragm being movable along a path in response to pressure changes in said sensing chamber;

resilient means for resisting movement of the diaphragm in at least one direction along said path;

said wall means having an inlet passage and a vent passage with both of said passages leading to said sensing chamber;

first check valve means for allowing fluid flow through the inlet passage and into the sensing chamber and for preventing fluid flow in the reverse direction from said sensing chamber through said inlet passage;

pressure relief valve means for at least partially venting said sensing chamber through said vent passage in response to the pressure differential across the pressure relief valve means reaching about a predetermined magnitude;

switch means mounted on said housing and operable by the movement of said movable portion of said diaphragm along said path; and said pressure relief valve means including a valve member extending through said vent passage whereby the valve member extends from inside said sensing chamber to outside said sensing chamber, a valve seat on said wall means outside said sensing chamber and a valve surface on said valve member, said valve surface being outside said sensing chamber, and resilient means for urging said valve surface against said valve seat to effectively close said vent passage.

11. A pressure switch as defined in claim 10 wherein said housing has a cavity therein and said diaphragm divides that cavity into said sensing chamber and a switch chamber, said switch and said resilient means being in said switch chamber, and said pressure switch includes a plunger, said plunger having a rigid portion driven by said movable portion of said diaphragm along said path, said switch means includes a switch operating element in the path of movement of said rigid portion and being operable thereby.

12. A pressure switch comprising:

wall means defining a housing;

a pressure responsive diaphragm in said housing and cooperating therewith to define a sensing chamber, at least a portion of said diaphragm being movable along a path in response to pressure changes in said sensing chamber;

resilient means for resisting movement of the diaphragm in at least one direction along said path;

said wall means having an inlet passage and a vent passage with both of said passages leading to said sensing chamber;

first check valve means for allowing fluid flow through the inlet passage and into the sensing chamber and for preventing fluid flow in the reverse direction from said sensing chamber through said inlet passage;

pressure relief valve means for at least partially venting said sensing chamber through said vent passage in response to the pressure differential across the pressure relief valve means reaching about a predetermined magnitude;

switch means mounted on said housing and operable by the movement of said movable portion of said diaphragm along said path;

said pressure relief valve means including a valve member extending through said vent passage and terminating outside said sensing chamber and second check valve means outside said sensing chamber, at least a portion of the second check valve means being carried by said valve member, a portion of said valve member being engageable with a portion of said wall means outside said sensing chamber to close said vent passage; and said second check valve means including a check valve element movably mounted on said valve member and resilient means for urging said check valve element along said valve member, said check valve element being within said housing, said second check valve means including a valve seat on said housing engageable with the check valve element.

13. A pressure switch as defined in claim 5 wherein said vent passage extends from said sensing chamber to said flow passage.

14. A pressure switch as defined in claim 13 wherein said pressure relief valve means includes a movable valve element extending through the vent passage for opening and closing the vent passage and check valve means carried at least partially by said valve element for blocking fluid flow through said flow passage from the outlet to the inlet.

* * * * *